US008643458B2

(12) United States Patent
Hanov

(10) Patent No.: US 8,643,458 B2
(45) Date of Patent: Feb. 4, 2014

(54) WINDING AND METHOD FOR PRODUCING A WINDING

(75) Inventor: Rudolf Hanov, Weilheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/264,836

(22) PCT Filed: Apr. 16, 2009

(86) PCT No.: PCT/EP2009/002976
§ 371 (c)(1),
(2), (4) Date: Oct. 17, 2011

(87) PCT Pub. No.: WO2010/118762
PCT Pub. Date: Oct. 21, 2010

(65) Prior Publication Data
US 2012/0044035 A1 Feb. 23, 2012

(51) Int. Cl.
*H01F 27/30* (2006.01)

(52) U.S. Cl.
USPC ..... 336/198

(58) Field of Classification Search
USPC ..... 336/196, 65, 198, 206–208
See application file for complete search history.

(56) References Cited

U.S. PATENT DOCUMENTS

| | | | | |
|---|---|---|---|---|
| 3,428,927 | A | 2/1969 | Favereau | |
| 3,458,650 | A * | 7/1969 | Hiroshi et al. | 174/117 F |
| 5,428,337 | A | 6/1995 | Vinclarelli et al. | |
| 5,563,582 | A | 10/1996 | D'Hont | |
| 6,515,346 | B1 * | 2/2003 | Kemeny | 257/618 |
| 7,064,644 | B2 | 6/2006 | Weber et al. | |
| 7,312,686 | B2 * | 12/2007 | Bruno | 336/229 |
| 7,982,570 | B2 * | 7/2011 | Burdick et al. | 336/200 |
| 7,990,244 | B2 * | 8/2011 | Huss et al. | 336/198 |
| 2002/0036561 | A1 * | 3/2002 | Jedlitschka | 336/232 |
| 2002/0046870 | A1 | 4/2002 | Zein et al. | |

FOREIGN PATENT DOCUMENTS

| | | | |
|---|---|---|---|
| CN | 1459807 | A | 12/2003 |
| DE | 1539623 | A1 | 6/1969 |
| DE | 1913972 | A1 | 10/1970 |
| DE | 1765537 | A1 | 7/1971 |
| DE | 26 09 548 | A1 | 12/1976 |
| DE | 32 14 171 | A1 | 11/1982 |
| DE | 32 05 048 | A1 | 8/1983 |
| DE | 245748 | B5 | 4/1994 |
| DE | 19809572 | C2 | 6/2000 |
| EP | 0 077 240 | A1 | 4/1983 |
| EP | 0 557 608 | A1 | 9/1993 |
| EP | 0710964 | A2 | 5/1996 |
| JP | 55033130 | A | 3/1980 |
| JP | 60141021 | A | 7/1985 |

(Continued)

*Primary Examiner* — Tuyen Nguyen
(74) *Attorney, Agent, or Firm* — Laurence A. Greenberg; Werner H. Stemer; Ralph E. Locher

(57) ABSTRACT

A winding includes a wound electrical conductor having an electrical insulator. A method is also provided for producing a winding. The winding can be produced as a single piece by using a support on which the electrical conductor can be disposed and electrically insulated. The support is particularly implemented in the form of a cylindrical spiral as a coil, and thereby allows practically unlimited single-piece production of the winding. The cross section and/or the width of the electrical conductor can simultaneously be varied by location on the support.

9 Claims, 3 Drawing Sheets

(56) References Cited

FOREIGN PATENT DOCUMENTS

| | | | |
|---|---|---|---|
| JP | 61000711 | U | 1/1986 |
| JP | 62031810 | B | 7/1987 |
| JP | H0629117 | U | 4/1994 |
| JP | 2000315427 | A | 11/2000 |
| JP | 2004319675 | A | 11/2004 |
| RU | 2040056 | C1 | 7/1995 |
| RU | 2258273 | C2 | 8/2005 |

* cited by examiner

WINDING AND METHOD FOR PRODUCING A WINDING

BACKGROUND OF THE INVENTION

Field of the Invention

The invention relates to a winding having a wound electrical conductor, with the electrical conductor having electrical insulation. Furthermore, the invention relates to a method for producing a winding.

The production of a power transformer as a cast-resin transformer or as a distribution transformer for high-voltage power supply systems, is a highly labor-intensive and costly process. In particular, the coils for the low-voltage and high-voltage windings can currently be wound only in the plurality of complex process steps. For this purpose, partial windings of a wound-on wire are wound on a winding machine such that the necessary winding diameter is achieved. The partial windings which have been produced in this way are then connected to one another as a high-voltage winding or low-voltage winding by means of appropriate connecting elements, as described by way of example in DE 198 09 572 C2.

DE 260 95 48 C2 likewise describes a winding arrangement for high-current transformers having an iron core and coils, with the conductor dimension in the axial direction corresponding to the coil height, and with all the turns of each coil being connected in series, with the number of turns in each coil decreasing from the center to the end of the winding.

Furthermore, DE 32 14 171 A1 describes a high-current transformer having an induction coil, with a disk coil containing a plurality of turns, in each of which series-connected partial conductors lie on one and the same radial plane with respect to the core limb.

DE 15 39 623 likewise describes a device for producing homogeneous magnetic fields with a very high field strength. The stray flux in the external area of the device for producing homogeneous magnetic fields is reduced by two groups of conductors through which current flows in parallel in opposite directions, as a result of which the external magnetic field is reduced in practice.

DE 245 748 A1 likewise describes a winding having high-current output conductors.

It is desirable to be able to produce the electrical winding in one piece, since this would make it possible to avoid separations between the partial windings.

BRIEF SUMMARY OF THE INVENTION

The object of the present invention is to provide a winding and a method for producing a winding, which ensure the production of an integral coil.

The object is achieved by a winding having a wound electrical conductor, in which the electrical conductor has electrical insulation at least in places. At least two electrical conductors are disposed on a support, with the electrical conductors being isolated from one another and with the support having a curved shape.

The object is also achieved by a method for producing a winding having a wound electrical conductor, in which the electrical conductor has electrical insulation. At least two electrical conductors are disposed on a support, with the electrical conductors being isolated from one another and with the support being bent to a curved shape.

According to the invention, at least two electrical conductors are arranged on a support, with the electrical conductors being isolated from one another, and with the support having a curved shape. The support is shaped as a line ribbon by shaping by means of an apparatus, such that the radius of the finished winding is ensured by the support ribbon which has been shaped in this way. This makes it possible to produce a winding as a continuous, integral coil, thus avoiding an electrical connection to the partial windings of the coil which are normally required. This advantageously reduces stress loads between the individual windings to a minimum level thus, in particular, making it possible to produce windings which are resistant to high voltage.

This likewise avoids the unwinding of an electrical conductor as is normally required in the past, for example of a copper or aluminum wire, and the subsequent winding of the electrical conductor onto a winding former, which was generally highly labor intensive. The capability to arrange the electrical conductors on the support relative to one another allows the stress load and the electrical interaction between the electrical conductors to be predetermined very precisely, and in a defined manner.

In one advantageous refinement of the winding, the support is in the form of a cylindrical helix, therefore ensuring that the electrical conductor is produced in one piece. The helical shape as a support actually ensures that the corresponding coil can in practice be produced using an endless process and as a result of which only the different radii of the windings and/or the axial extent are/is the only limiting factor for production of the winding.

A support element as a relevant disk is advantageously precluded, in which case the support element can be combined with further support elements to form a support by means of cutout and/or connecting elements. A support can be formed quickly and easily within the production process because of the possibly modular design of the support consisting of support elements.

In one advantageous refinement of the winding, the support can be subdivided by laser treatment into electrically conductive zones as electrical conductors and into electrically insulating zones as insulation. The invention furthermore provides that the support can be subdivided by electrochemical treatment into electrically conductive zones as electrical conductors and into electrically insulating zones as insulation. Individual electrically conductive and electrically insulating regions can thus be designed by means of laser and/or electrochemical treatment of the support, and a corresponding winding can be formed on the support in this way. The process and treatment methods which are required to do this ensure simple and defined production of the electrically insulating and electrically conductive zones. Alternatively, the support can also be treated mechanically in order to produce conductive and/or non-conductive regions.

The invention furthermore advantageously provides that cutouts are provided in the support in order to introduce electrically conductive materials, in particular carbon nanotubes, with the electrically conductive materials defining the electrical conductor. The introduction of electrically conductive materials into cutouts which have previously been defined in the support allows electrical conductor tracks to be defined and produced quickly and easily. In order to ensure adequate insulation between individual segments of the support, the invention provides that an insulation film can be introduced between individual segments of the support during the production process.

In order to compensate for possible different stress loads in different segments of the winding or of the support, the invention provides that the width and/or the cross section of the electrical conductors on the support can be varied as a function of the position. The variation of the width and/or of the cross section of the electrical conductor makes it possible to compensate for electrical loads, in particular voltage overloads, by means of the design measures. It is likewise possible to vary the number and/or dimensions of the conductors in specific segments of the winding as a result of the heat development within the winding and/or the support so as to ensure virtually the same thermal load in the winding. This form of technical manufacture is impossible by means of a conventional electrical conductor with a fixed cross section.

The electrical conductors are arranged parallel to one another on the support. Furthermore, the support can advantageously be composed of an electrically insulating material.

According to the invention, a method is likewise provided for producing a winding, with at least two electrical conductors being arranged on a support, with the electrical conductors being isolated from one another, and with the support being bent into a curved shape. The support is advantageously in the form of a cylindrical helix, with the radius of this helical shape formed in this way corresponding to the radius of the winding.

Further advantageous refinements result from the dependent claims. The invention will be explained in more detail with reference to a number of exemplary embodiments in the drawings, in which:

DESCRIPTION OF THE INVENTION

Figure 1:
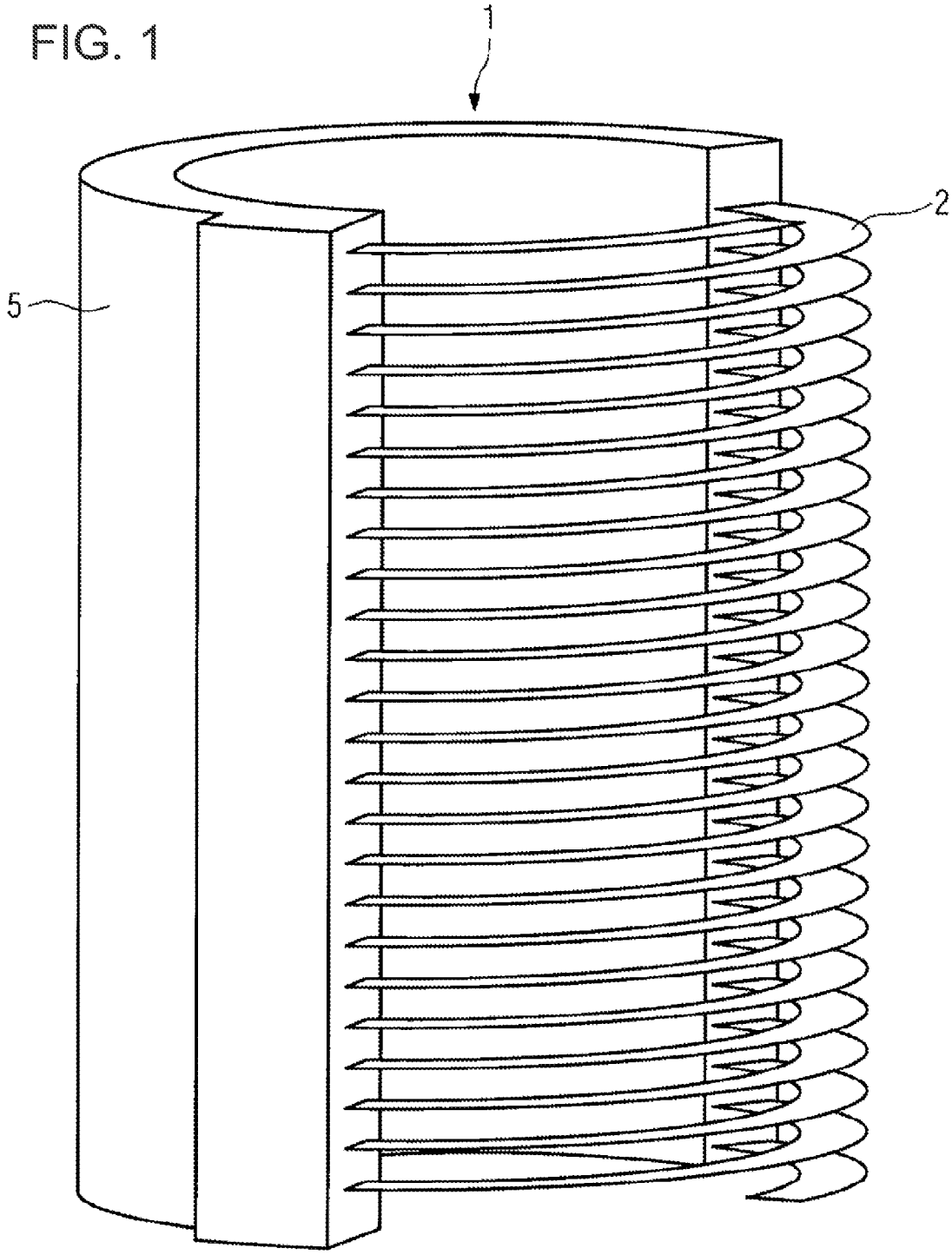
FIG. 1 shows a perspective view of the winding.

FIG. 1 shows a perspective view of the winding 1. In the example illustrated in FIG. 1, an electrical conductor 3*a*, 3*b*, 3*c*, 3*d* (not illustrated) and electrical insulation 4*a*, 4*b*, 4*c* at least in places, are applied to a support 2. The support 2 has a curved shape which corresponds to the radius of the winding 1. The electrical insulation 4*a*, 4*b*, 4*c* in the example illustrated in FIG. 1 is ensured by cast-resin sheathing 5. To this extent, it is possible for corresponding electrical conductors 3*a*, 3*b*, 3*c*, 3*d* to be arranged on the support 2, and for appropriate cast-resin sheathing 5 to completely surround the support 2 in a subsequent manufacturing process. Because of the electrical insulation characteristics of the cast-resin sheathing 5, the cast-resin sheathing therefore carries out the function of the electrical insulation 4*a*, 4*b*, 4*c*.

Figure 2:
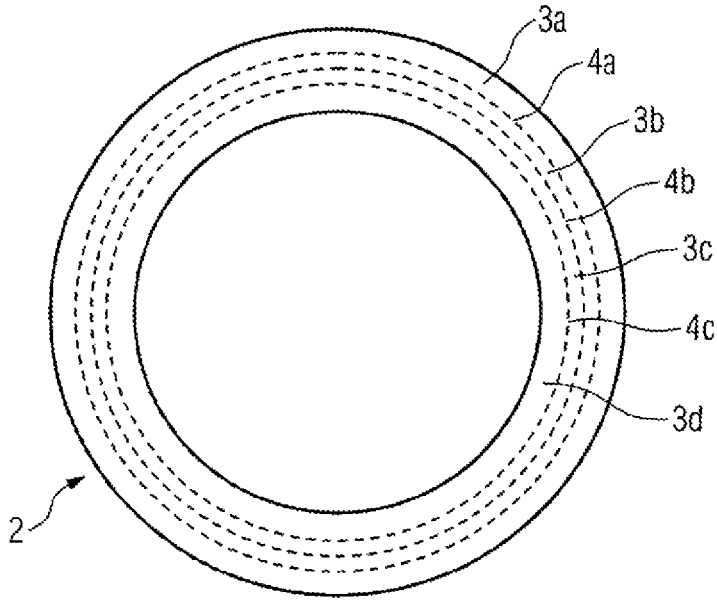
FIG. 2 shows a plan view of the support with four electrical conductors.

FIG. 2 shows a plan view of the support 2 with four electrical conductors 3*a*, 3*b*, 3*c*, 3*d*. Electrical insulation 4*a*, 4*b*, 4*c* is arranged on the support 2, between the respective electrical conductors 3*a*, 3*b*, 3*c*, 3*d*. It is either possible for the electrical conductor 3*a*, 3*b*, 3*c*, 3*d* to be applied to the support 2 which is composed of an insulation material. In this case, the cavities between the conductors 3*a*, 3*b*, 3*c*, 3*d* are automatically electrically isolated, and have corresponding insulation areas 4*a*, 4*b*, 4*c*. It is likewise possible for the support 2 to be composed of an electrically conductive material and for regions between the individual conductors 3*a*, 3*b*, 3*c*, 3*d* to be modified by deliberate process methods such that they have an electrical insulation characteristic, and therefore represent electrical insulation 4*a*, 4*b*, 4*c*.

Figure 3:
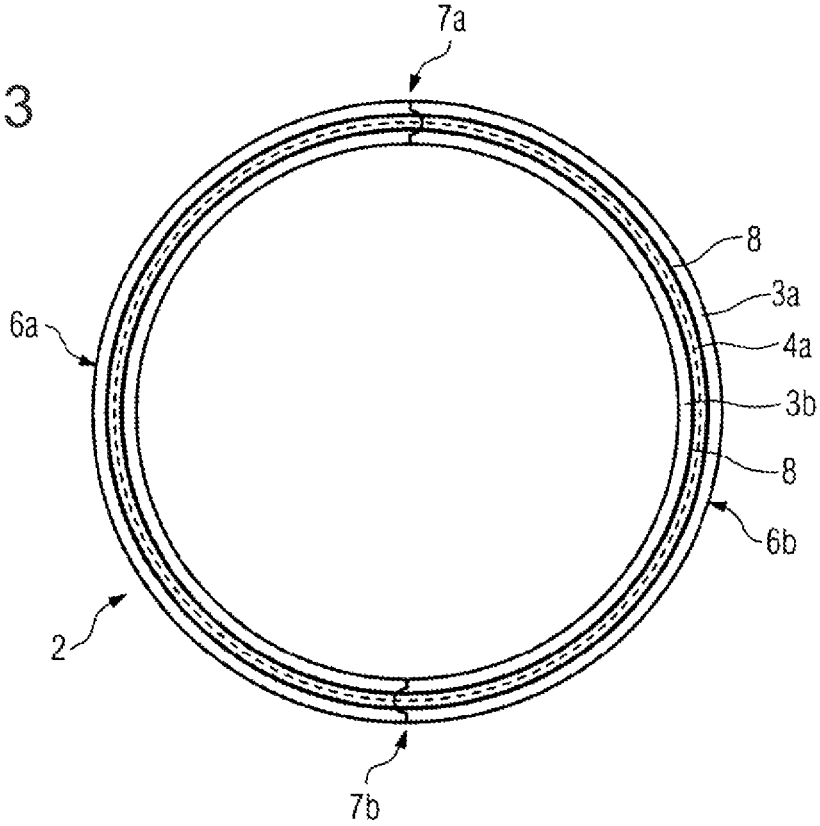
FIG. 3 shows a plan view of a support consisting of two support elements.

FIG. 3 illustrates a plan view of a support 2 consisting of two support elements 6*a*, 6*b*. The support 2 has two electrical conductors 3*a*, 3*b*, which are arranged parallel to one another. Electrical insulation 4*a* is arranged between the electrical conductors 3*a*, 3*b*. The support 2 consists of two support elements 6*a*, 6*b* which can be combined to form a support by means of appropriate connecting elements 7*a*, 7*b*. In particular, the connecting elements 7*a*, 7*b* are shaped to ensure a simple, fixed and permanent connection. In particular, this covers shapes which correspond to one another such as dovetail connections. Conventional connection techniques, such as screw connection or welding, are also possible by means of the abovementioned connecting elements 7*a*, 7*b*. It is either possible to form respective circular segments of the support 2 which have a respective vertical connection to further support segments of the support 2 which are arranged at the top and/or at the bottom. Furthermore, it is possible by means of the support elements 6*a*, 6*b* to design the support 2 in the form of a cylindrical helix, thus making it possible to produce a winding 1 with a virtually endless profile.

FIG. 3 further shows cutouts 8 formed in the support 2 in order to introduce the electrically conductive materials, in particular carbon nanotubes, with the electrically conductive materials defining the electrical conductor 3*a*, 3*b*, 3*c*. The introduction of the electrically conductive materials into the cutouts 8 which have previously been defined in the support 2 allows electrical conductor tracks to be defined and produced quickly and easily.

Figure 4:
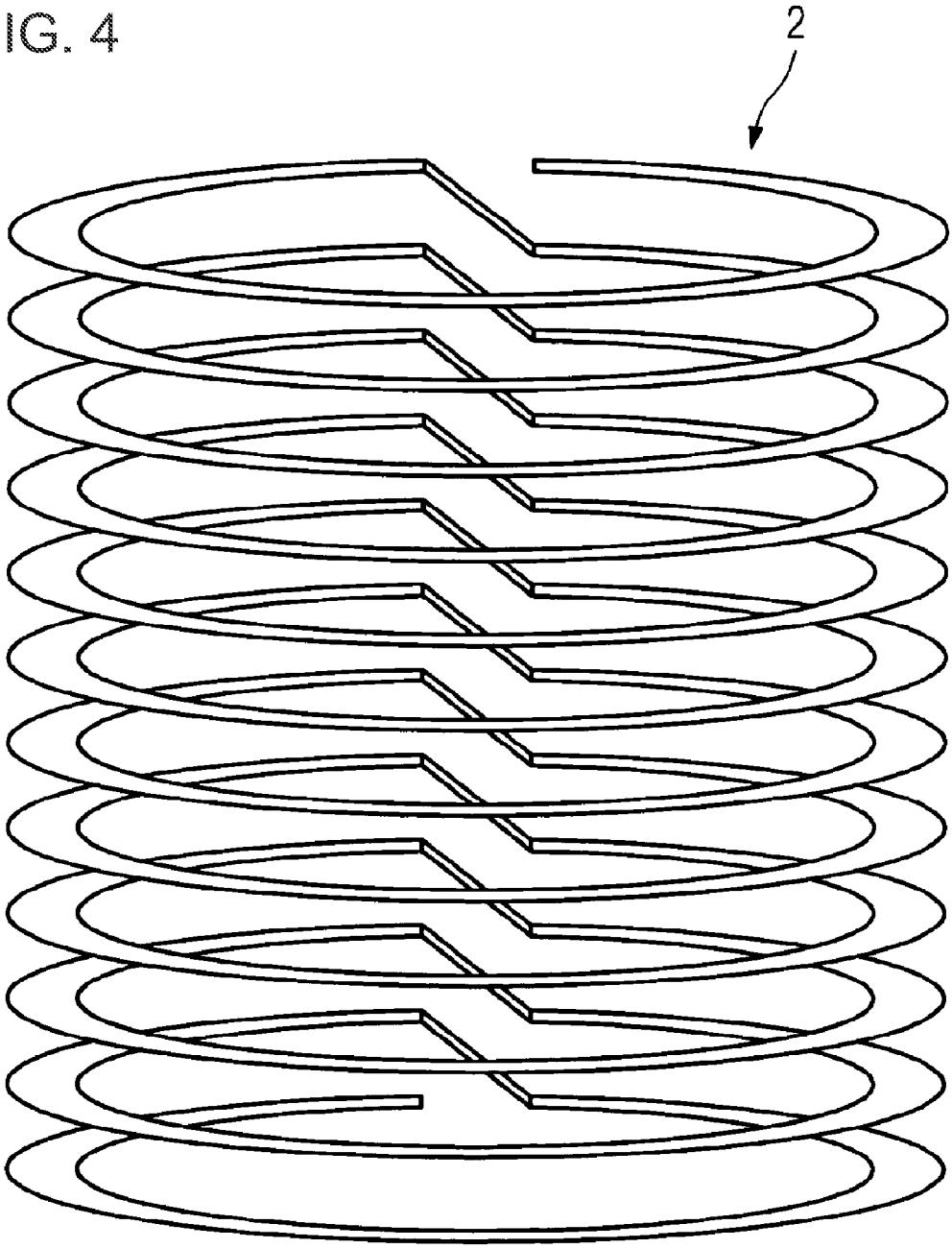
FIG. 4 shows a perspective view of a helical support.

FIG. 4 shows a perspective view of a helical support 2. This support shape advantageously makes it possible to design a coil with a virtually infinite length. This makes it possible to produce a winding 1 independently of corresponding partial windings, thus considerably speeding up and reducing the cost of the manufacturing process.

The method according to the present invention results in the advantage that a winding 1 can be produced as a continuous, integral coil. This avoids the production of individual coils or partial windings which first of all have to be connected to form a winding 1, in a highly complex manner. The electrical connections which are required in this case have a negative influence on the performance of the corresponding winding 1. Furthermore, there is no need for radial cooling channels, thus ensuring that a winding 1 is smaller than conventional windings. Furthermore, the possible stress load between the individual turn segments within the overall winding 1 can be calculated, and appropriate winding measures can be taken to completely avoid points with relatively high stress loads. In particular, the routing of the electrical conductor 3*a*, 3*b*, 3*c*, 3*d* on the support as well as the width and/or the cross section of the electrical conductors 3*a*, 3*b*, 3*c*, 3*d* can therefore be varied deliberately thus minimizing the stress load by manufacturing techniques. This results in the capability to produce windings 1 which are more resistant to test voltages than previously known windings.

The invention claimed is:

1. A winding, comprising:

support having a curved shape being a cylindrical helix shape;

at least two electrical conductors wound on said support, said at least two electrical conductors formed in one piece on said support; and electrical insulation at least partly isolating said at least two electrical conductors from one another.

2. The winding according to claim 1, which further comprises:

a support element in the form of an integral disk; and connecting elements for combining said support element with further support elements to form said support.

3. The winding according to claim 1, wherein said support is configured to be subdivided by laser treatment into electrically conductive zones as said at least two electrical conductors and into electrically insulating zones as said electrical insulation.

4. The winding according to claim 1, wherein said support is configured to be subdivided by electrochemical treatment into electrically conductive zones as said at least two electrical conductors and into electrically insulating zones as said electrical insulation.

5. The winding according to claim 1, wherein said support has cutouts formed therein for introducing electrically conductive materials defining said at least two electrical conductors.

6. The winding according to claim 5, wherein said electrically conductive materials are carbon nanotubes.

7. The winding according to claim 1, wherein said at least two electrical conductors are variable in at least one of width or cross section on said support as a function of position.

8. The winding according to claim 1, wherein said at least two electrical conductors are disposed parallel to one another on said support.

9. The winding according to claim 1, wherein said support is formed of an electrically insulating material.

* * * * *